United States Patent [19]

Whitney

[11] 4,187,483

[45] Feb. 5, 1980

[54] MULTI-THROW MAGNETIC REED SWITCH

[76] Inventor: C. David Whitney, 9320 Earl St., Apt. #28, La Mesa, Calif. 92041

[21] Appl. No.: 938,221

[22] Filed: Aug. 30, 1978

[51] Int. Cl.[2] ..... H01H 9/00

[52] U.S. Cl. ..... 335/206; 335/154

[58] Field of Search ..... 335/205, 206, 207, 151, 335/153, 154

[56] References Cited

U.S. PATENT DOCUMENTS

| | | | |
|---|---|---|---|
| 3,223,801 | 12/1965 | Cummins et al. | 335/206 |
| 3,268,684 | 8/1966 | Keller et al. | 335/206 X |

*Primary Examiner*—George Harris
*Attorney, Agent, or Firm*—Brown & Martin

[57] ABSTRACT

The disclosed invention includes a pair of spaced apart parallel plates with a plurality of reed switches lying between and perpendicular to these plates. One of the plates has a hole through it, and the reed switches are spaced around this hole at equal distances from each other. A control arm having a permanent magnet attached thereto protrudes through the hole. This magnet is used to close selectable ones of the reed switches by pivoting the arm about the hole to thereby move the magnet in close proximity with the selected switches.

10 Claims, 4 Drawing Figures

MULTI-THROW MAGNETIC REED SWITCH

BACKGROUND OF THE INVENTION

This invention relates to multi-throw switches, and more particularly to multi-throw switches that are operated by movement of a single control arm. Multi-throw switches include, for example, a single-pole-quadra-throw switch and a quadra-pole-quadra-throw switch. Basically, the former may be represented schematically by four separate momentary contact switches; while the latter may be represented schematically by four separate pairs of momentary contact switches. Preferably, these separate switches or switch pairs are somehow selectively opened and closed in response to movement of a single control arm.

Such multi-throw switches have a wide variety of applications. For example, they may be used to control the position of a TV camera or the mechanical arm of a robot. Basically, this is achieved by use of a DC motor in conjunction with the multi-throw switch wherein the polarity of the control voltage across the motor is determined by the state of the switch. That is, the control voltage across the motor may be made either positive, negative, or zero in response to the switch positions; and the motor will turn in one direction, or the opposite direction, or stop respectively in response to these voltages.

In the prior art however, a difficult problem existed because there was no inexpensive simple mechanism for manually controlling the various switch throw positions with a single control arm. As an alternative a single-pole-quadra-throw switch could be implemented by four momentary contact switches each of which have a separate push button to control its state. This configuration would be simple and inexpensive to implement, but functionally it would be clumsy at best. The four push buttons per switch simply take up too much physical space. Further, a single control arm control for a multi-throw switch is desirable because it allows for ease of coordination between the switch operator and the device being controlled. It is easier, for example, to control the flight of an airplane by moving a single control arm either forward, backward, left, or right than to fly the plane by pushing four individual push buttons.

The problem of providing a simple inexpensive linkage between one control arm and the various switch contacts is further complicated when the multi-throw switch is to be used in an explosive environment. There, the linkage mechanism must not prevent the contacts from being insulated such that contact flashings is not a problem. Similarly, if the switch is to be used in a highly corrosive environment, the linkage mechanism must not prevent the contacts from being enclosed.

Therefore, it is one object of the invention to provide an improved multi-throw switch having a single control arm.

Another object of the invention is to provide a multi-throw switch that is comprised of a plurality of reed switches wherein selective ones of the reed switches are closed by moving a magnet on the end of a control arm in close proximity to the selected reed switches.

Another object of the invention is to provide an improved single level arm control mechanism for a multi-throw switch that also has multi-poles.

Still another object of the invention is to provide an improved multi-throw switch that is operable in explosive and corrosive environments.

SUMMARY OF THE INVENTION

These and other objects are accomplished in accordance with the invention by a multi-throw switch that includes a pair of spaced apart parallel plates with one of the plates having a hole through it. Between these plates, at equal distances from the hole, is a plurality of encapsulated reed switches. These switches lie perpendicular to the plates and equal distant from each other. Individual ones of the switches are closed by movement of a magnet in close proximity thereto. The magnet is mounted on the end of a control arm; and that end protrudes through the hole to lie between the plates. This arm has a ball joint at the hole that allows the arm to be pivoted about the hole.

In one embodiment, a total of four reed switches are equally spaced from each other between the plates; while in another embodiment, four pairs of reed switches are equally spaced from each other between the plates. Individual ones of these switches, or switch pairs, are closed by pivoting the control arm about the ball joint to thereby move the magnet in close proximity with the switch to be closed. These embodiments may be either of the "make-before-break" or "break-before-make" type. That is, by using a magnet having a relatively large magnetic field strength, to consecutive reed switches, or reed switch pairs, may be simultaneously closed by moving the magnet approximately midway therebetween. Conversely, by choosing a magnet having a relatively small magnetic field strength two consecutive reed switches, or switch pairs, will both be open when the magnet is moved midway therebetween. Preferably, these embodiments also include printed etching on the plates which interconnect the reed switches in a predetermined manner. Also, preferably connectors are included on the plates to allow the multi-throw switch to be easily inserted into a control system.

BRIEF DESCRIPTION OF THE DRAWING

Various preferred embodiments of the invention will best be understood by reference to the following drawings while reading the detailed description, wherein.

DETAILED DESCRIPTION

A first embodiment of the invention will now be described in conjunction with FIG. 1. This embodiment includes a pair of spaced apart parallel plates 10 and 11. Four pairs of spacers 12, 13, 14, and 15 are included to separate the plates and hold them in place. These plates and spacers preferably are made of plastic, although any rigid material may suitably be used.

Figure 1:
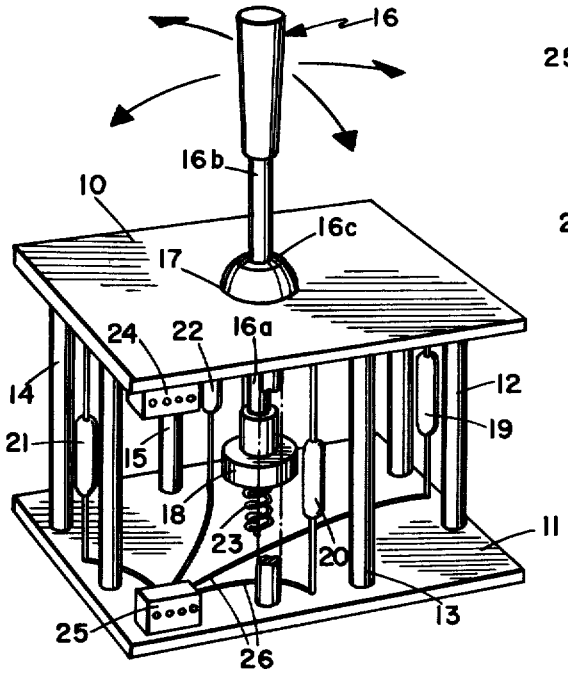
FIG. 1 is a pictorial view of a first embodiment of a multi-throw switch constructed according to the invention.

Also included, in the FIG. 1 embodiment, is a control arm 16. This arm has one portion **16*a* which protrudes through a hole 17 in plate 10, and has a second portion 16*b* which extends above hole 17. Portions 16*a* and 16*b*** are separated by a ball joint 16c. This ball joint allows the arm to be pivoted about hole 17.

Also included in the FIG. 1 embodiment is a permanent magnet 18, and four encapsulated reed switches 19, 20, 21 and 22. Magnet 18 is fixedly mounted on the end of control arm portion 16a; while switches 19–22 are mounted between respective pairs of the spacers 12–15. By this arrangement, magnet 18 can be moved in close proximity to selectable ones of the switches 19–22 simply by manually moving portion 16b of the arm. And in response to the magnet's field, the various switches are thus opened and closed by movement of the control arm.

Figure 2:
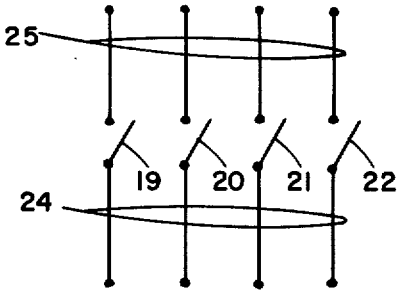
FIG. 2 is a schematic circuit diagram of the FIG. 1 embodiment.

FIG. 2 is a schematic circuit diagram of the FIG. 1 apparatus. When arm 16 is positioned approximately perpendicular to plate 10, magnet 18 is not in close proximity to any of the reed switches 19–22. Thus, in this state, switches 19–22 are all open. This is termed the neutral position. Preferably, a spring 23 connects between magnet 18 and plate 11 to insure that the neutral state is entered when no manual force is applied to arm 16.

Any one of the switches 19–22 may be selectively closed simply by moving magnet 18 towards the selected switch. In addition, a "make-before-break" or "break-before-make" type of multi-throw switch may be achieved simply by properly choosing the field strength for magnet 18. If this field strength is relatively large, then two consecutive reed switches will be closed simultaneously by moving magnet 18 approximately midway therebetween. Conversely, if the field strength of magnet 18 is relatively small, then two consecutive reed switches will open when magnet 18 is placed approximately midway therebetween.

Preferably, the FIG. 1 embodiment also includes connectors 24 and 25 as illustrated. These allow the apparatus to be easily connected into a system. Printed circuit etching 26 also preferably is included on the face of plates 10 and/or 11. This provides a means for the terminals of switches 19–22 to be connected to the various terminals in connectors 24 and 25.

Figure 4:
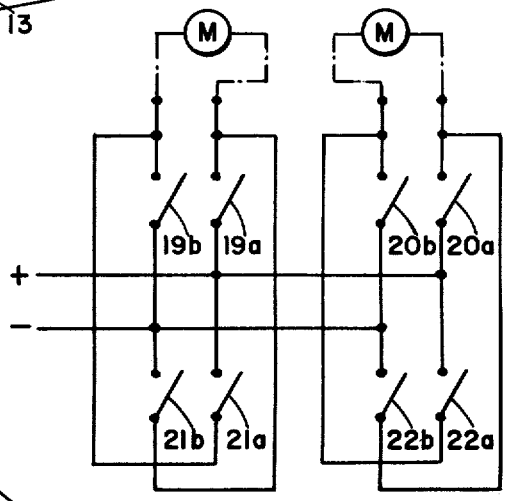
FIG. 4 is a schematic circuit diagram of the embodiment of FIG. 3.
Figure 3:
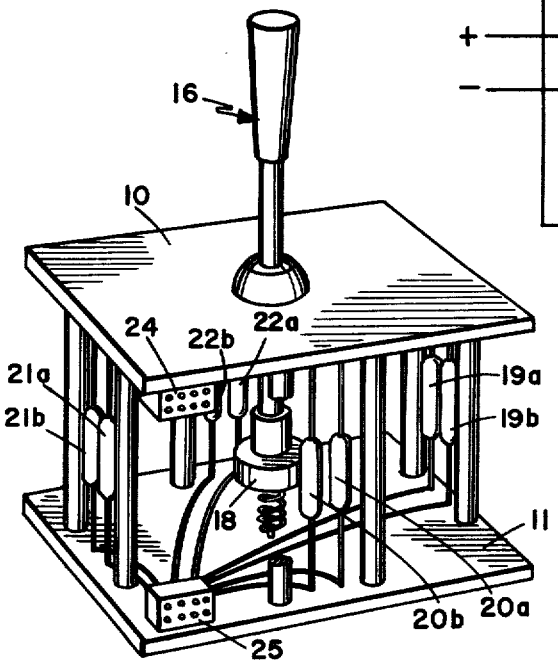
FIG. 3 is a pictorial view of a second embodiment of a multi-throw switch constructed according to the invention.

A second embodiment of the invention will now be described in conjunction with FIG. 3. This embodiment is similar to the first embodiment, and like parts are identified by like reference numerals. The major difference between the two embodiments is that in the latter, a pair of switches (rather than a single switch) is included between spacers 12–15. These pairs of switches are identified by reference numerals 19a and 19b, 20a, and 20b, and 21a and 21b, and 22a and 22b. Another difference between the two embodiments is that the interconnections between the switches is different. FIG. 4 is a schematic circuit diagram of the interconnections in the FIG. 3 embodiment.

The second embodiment is particularly useful to directly control two motors. These motors may be used, for example, to control the pan and tilt position of a TV camera. A multitude of other uses are also possible. Again, by appropriately choosing the strength of the magnet 18, the embodiment can be made of either the "make-before-break" type or "break-before-make" type. For example, when the field strength of magnet 18 is relatively large, switch pairs 19a–19b, and 20a–20b may be simultaneously closed. This is desirable for applications such as the positioning of a camera as described above.

Two preferred embodiments of the invention have now been described in detail. However, many changes and modifications can be made to these embodiments without departing from the nature and spirit of the invention. For example, while the preferred embodiments have been illustrated as showing only four spacers with respective reed switches connected thereto, it is to be understood that any number of spacers with respective switches may be positioned around the magnet. Further while FIGS. 2 and 4 illustrate particular preferred interconnections for the switches, it is to be understood that various other interconnections may be simply made by changing the etchings 26.

Suppose, for example, that five reed switches are equally spaced apart in a quarter circle around magnet 18 between spacers 20 and 21. Then as magnet 18 is moved from midway between spacers 19 and 20 to midway between spacers 20 and 21, the state of these five switches will change in steps from all switches being open to all switches being closed. That is, first the switch nearest to spacer 20 will close; then the two switches closest to spacer 20 will close, etc. Thus, by connecting respective resistors in parallel across these switches, a stepped rheostat is formed.

Therefore, since many changes and modifications can be made without departing from the nature and spirit of the invention, the invention is not to be limited to said details but is defined by the appended claims.

Having described my invention, I now claim:

1. A multi-throw magnetic switch comprising:

a pair of spaced apart parallel plates, one of said plates having a hole through it;

a first plurality of reed switches lying between and perpendicular to said plates, said reed switches being equal distant from said hole and equal distant from each other;

a single control arm having one portion protruding through said hole to approximately midway between said plates, and having a second portion extending above said hole;

a permanent magnet means fixedly mounted on said one portion of said arm at approximately midway between said plates; and pivot means for allowing said arm to be pivoted about said hole by manually moving said second portion of said arm to thereby move said magnet in close proximity with, and thereby close, selectable ones of said reed switches.

2. A multi-throw switch according to claim 1, wherein said plurality of reed switches consists of four switches equally spaced around said magnet.

3. A multi-throw switch according to claim 2, wherein said magnet means has a magnetic field strength sufficient to close two consecutive ones of said reed switches when said magnet is moved miday therebetween by said control arm.

4. A multi-throw switch according to claim 2, wherein said magnet means has a magnetic field strength that closes none of said reed switches when said magnet is moved midway between two consecutive ones of said reed switches.

5. A multi-throw switch according to claim 1, and further including a second plurality of reed switches with respective ones of said second plurality lying alongside corresponding ones of said first plurality to thereby form a plurality of reed switch pairs.

6. A multi-throw switch according to claim 5, wherein said plurality of reed switches pairs consists of four pairs equally spaced around said magnet.

7. A multi-throw switch according to claim 6, wherein said magnet means has a magnetic field strength sufficient to close any two consecutive pairs of said reed switches when said magnet is moved midway therebetween by said control arm.

8. A multi-throw switch according to claim 6, wherein said magnet means has a magnetic field that closes none of said pairs of reed switches when said magnet is moved midway between two consecutive pairs of said reed switches.

9. A multi-throw switch according to claim 1, wherein said pivot means is a ball joint between said first portion and said second portion of said control arm.

10. A multi-throw switch according to claim 1, wherein each reed switch of said plurality is an encapsulated reed switch.

* * * * *